United States Patent [19]

Hanna

[11] 4,204,480

[45] May 27, 1980

[54] SHELVING SYSTEM

[75] Inventor: James L. Hanna, Athens, Ga.

[73] Assignee: The Mead Corporation, Dayton, Ohio

[21] Appl. No.: 741,669

[22] Filed: Nov. 15, 1976

Related U.S. Application Data

[63] Continuation of Ser. No. 600,412, Jul. 30, 1975, abandoned.

[51] Int. Cl.[3] ..... A47B 57/16

[52] U.S. Cl. ..... 108/108; 108/152; 211/187; 248/224.4; 248/243

[58] Field of Search ..... 108/1, 6, 10, 32, 96, 108/106–108, 111, 152; 248/224.4, 242, 243; 211/49 R, 49 S, 148, 176, 177, 193, 187, 190

[56] References Cited

U.S. PATENT DOCUMENTS

| | | | |
|---|---|---|---|
| 2,788,949 | 4/1957 | Gurries | 248/242 |
| 2,936,147 | 5/1960 | Stewart | 248/243 |
| 3,080,980 | 3/1963 | Gibbons | 211/176 X |
| 3,101,923 | 8/1963 | Streater | 248/242 |
| 3,556,023 | 1/1971 | Marschak | 108/1 |
| 3,729,161 | 4/1973 | Christensen | 248/242 |

FOREIGN PATENT DOCUMENTS

| | | | |
|---|---|---|---|
| 411278 | 11/1966 | Switzerland | 211/148 |
| 968263 | 9/1964 | United Kingdom | 248/242 |

*Primary Examiner*—William E. Lyddane
*Attorney, Agent, or Firm*—George A. Smith, Jr.

[57] ABSTRACT

In a shelving system having both vertical and oblique supports for removable shelves, identical shelves are interchangeably usable on either support by virtue of special tabs which are engageable with support slots in two possible ways. The same shelf, therefore, can be mounted horizontally on either the vertical or the oblique supports.

9 Claims, 4 Drawing Figures

SHELVING SYSTEM

CROSS REFERENCE TO RELATED APPLICATIONS

This application is a continuation of my application Ser. No. 600,412, filed July 30, 1975, now abandoned, and discloses subject matter claimed in the application of James Marshall Suttles, Ser. No. 600,488, filed July 30, 1975 and now U.S. Pat. No. 3,983,822.

BRIEF SUMMARY OF THE INVENTION

This invention relates to shelving systems, and particularly to a system of shelving wherein removable shelves are arranged on vertical and oblique slotted shelf support members.

The invention is particularly adapted, but not necessarily limited to use in the construction of soft drink display racks. Display racks, constructed of sheet metal are commonly used in grocery stores, supermarkets and the like for the display of soft drinks. Soft drinks are sold in bottles of various sizes, the smaller bottles being commonly packaged in cartons, and the larger quart sizes being in the form of individual bottles. The sizes of the small bottles may vary, and the relative proportion of cartons to large bottles in a particular display also varies, depending on the demand experienced by the particular vendor. For these reasons, soft drink display racks are normally supplied with removable shelves, adapted to be positioned for the optimum usage of available space.

A typical beverage rack comprises a sheet metal base, and a vertical shelf support extending upwardly from the rear of the base. Soft drink cartons are normally stacked on the base, and larger bottles are normally arranged on the shelves. In order to stabilize the stack of cartons, the upper surface of the base is, in some cases, tilted backwardly by a few degrees, and the backing, or shelf support is correspondingly tilted backwardly. This backward tilting provides a stable support for a stack of cartons, which can be four or five cartons high at times. The backward tilting also results in a shelf support which is wider at the bottom than at the top. Therefore it provides a stronger support for the shelves.

In accordance with the invention, in order to achieve a more efficient use of the available space while retaining the improved strength afforded by the wide bottom of the support, the shelf support consists of two parts, namely the lower part, having an oblique front, and a substantially vertical upper part. Identical shelves are interchangeably supported on both the vertical and oblique supports with their article-supporting surfaces both substantially horizontal. The structure in accordance with the invention provides a shelving system which has interchangeable shelves which simplify manufacture, distribution and construction and improve versatility, and which, at the same time, exhibits the advantages of greater strength and stability and the more efficient use of available space.

The principal features of the shelving system in accordance with the invention which give rise to the foregoing advantages are as follows.

The vertical support has a planar front surface disposed vertically, and has a series of uniformly spaced slots extending in the vertical direction on its front surface. The oblique support also has a planar front surface, disposed at an oblique angle with respect to the horizontal, and has a second series of uniformly spaced slots extending in the vertical direction on its front surface.

The shelf has a surface for supporting soft drink bottles or the like. At its rear, the shelf is provided with at least two tabs, one located above the other, and both adapted to extend into slots in the supports. The rear of the shelf is also provided with two separate surfaces adapted to engage the fronts of the supports, and these two separate surfaces are disposed at different angles relative to the supporting surface of the shelf.

When the shelf is mounted on the oblique support, a first of the two separate surfaces abuts the face of the oblique support. When the shelf is mounted on the vertical support, the second of the two separate surfaces abuts the face of the oblique support. In either case, the supporting surface of the shelf remains substantially horizontal.

The principal object of this invention is to provide a system of shelving wherein identical shelves may be mounted interchangeably on supporting members having surfaces disposed at different angles relative to the horizontal. Other objects and advantages other than those specifically mentioned will be apparent from the following detailed description when read in conjunction with the drawings.

DETAILED DESCRIPTION

Figure 1:
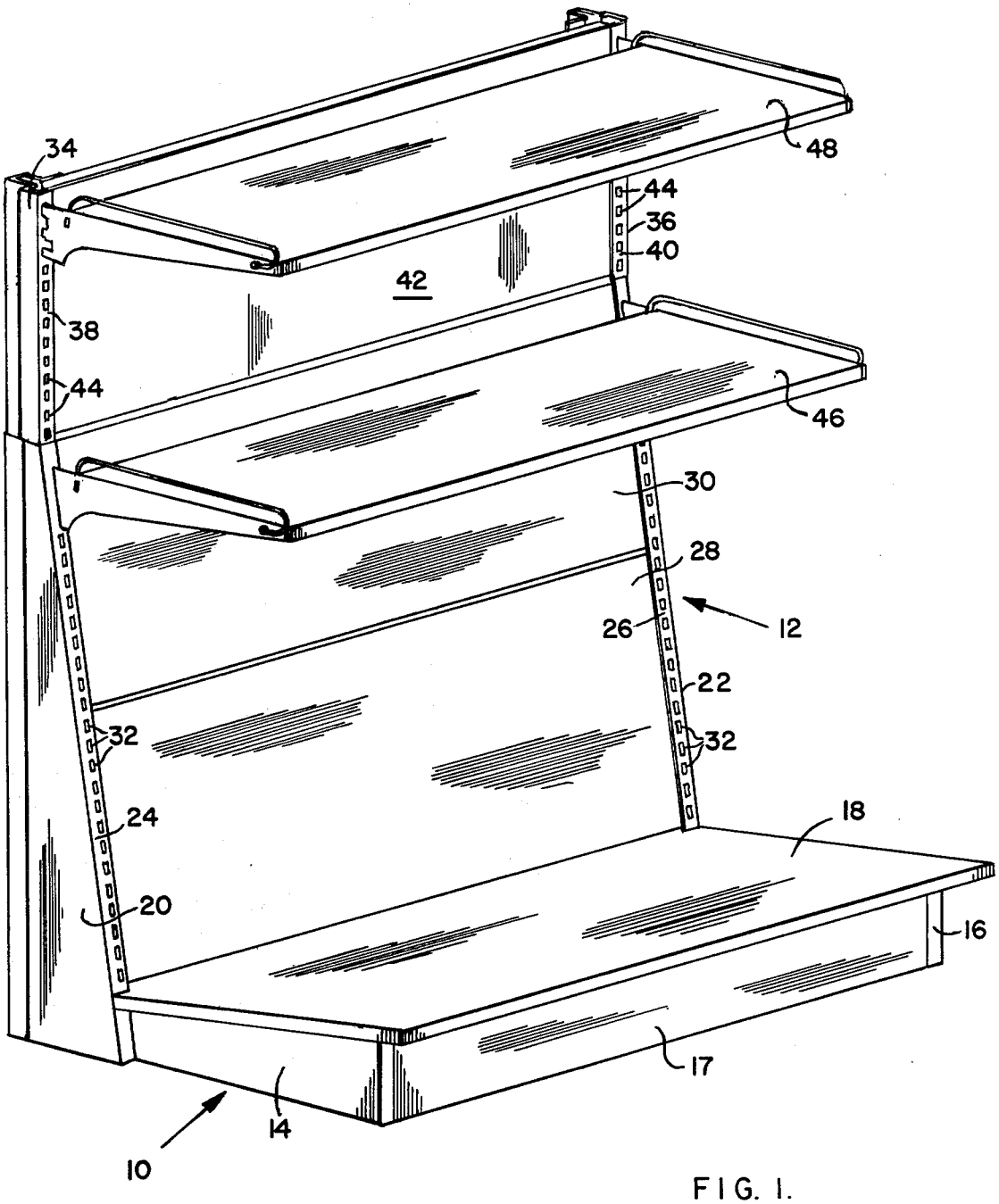
FIG. 1 is a perspective view of a shelving system in accordance with the invention.

FIG. 1 shows a soft drink display rack comprising a base 10 and an upright back 12. Base 10 comprises a pair of opposed side members 14 and 16, a front kick plate 17, and a top surface 18. Top surface is sloped backward slightly, preferably from about 3 degrees to about 7 degrees from horizontal. Side members 14 and 16 of the base are formed of sheet metal, and are integral with side members 20 and 22 respectively of the back.

These side members are wider at the bottom than at the top, and have front surfaces 24 and 26 which are preferably perpendicular to top surface 18 of the base, and therefore oblique with respect to the horizontal. Panels 28 and 30 are mounted on side members 20 and 22, and are likewise oblique and form a backing, allowing a stack of soft drink cartons to be supported at the bottom by surface 18, and at the rear by sloping panels 28 and 30.

Surfaces 24 and 26 have slots 32, which are uniformly spaced, and arranged in vertical lines. Surfaces 24 and 26 are integral with side members 20 and 22, and are of heavy gauge sheet metal. The space immediately behind these slots is clear.

The upper part of back member 12 comprises vertically extending members 34 and 36. These members preferably have uniform cross-section, and their front surfaces 38 and 40 are preferably vertical, although they may be sloped at some other desired angle relative to the horizontal. Members 34 and 36 fit into the tops of members 20 and 22 respectively in telescoping relationship.

A third panel 42 is secured between members 34 and 36. Panel 42 is vertical.

Elements 34 and 36 are provided with rows of uniformly spaced slots 44, arranged in vertical lines.

Figure 3:
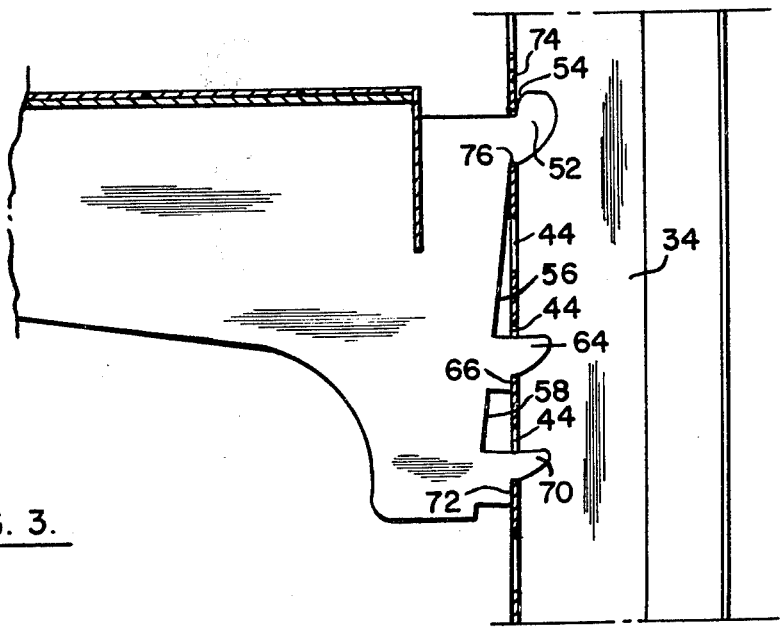
FIG. 3 is a vertical section showing how the tabs on the rear portion of a shelf cooperate with the slots in a vertical support member.
Figure 4:
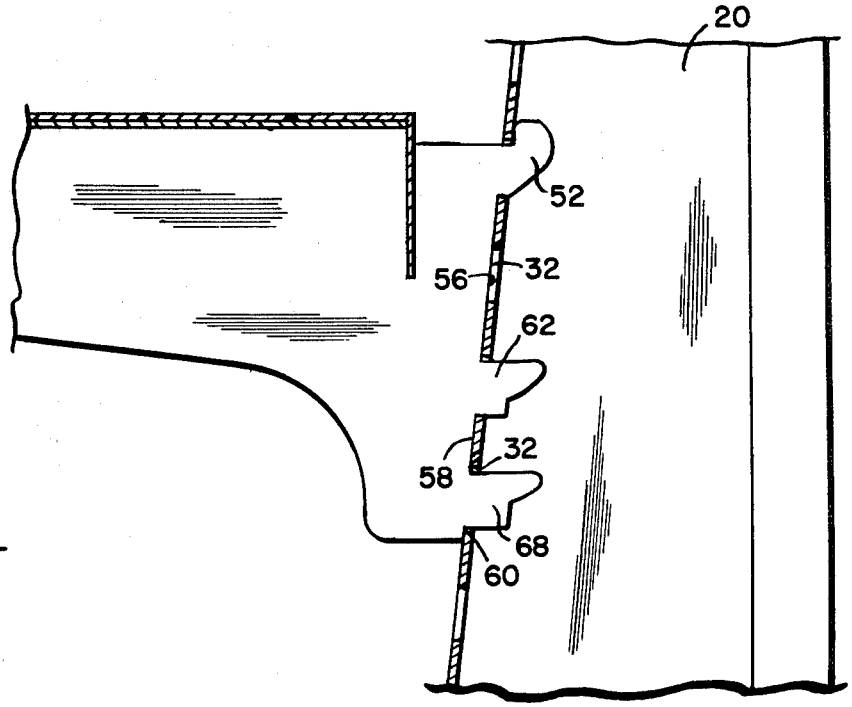
FIG. 4 is a vertical section showing how the tabs at the rear of the shelf cooperate with the slots on an oblique support member.

A first shelf 46, the upper surface of which is substantially horizontal, is shown supported on members 20 and 22. A second shelf 48, which is also horizontal, is shown mounted on members 34 and 36. Both these shelves are identical. The manner in which they cooperate with the slots in the supporting members is illustrated in FIGS. 2, 3 and 4.

Figure 2:
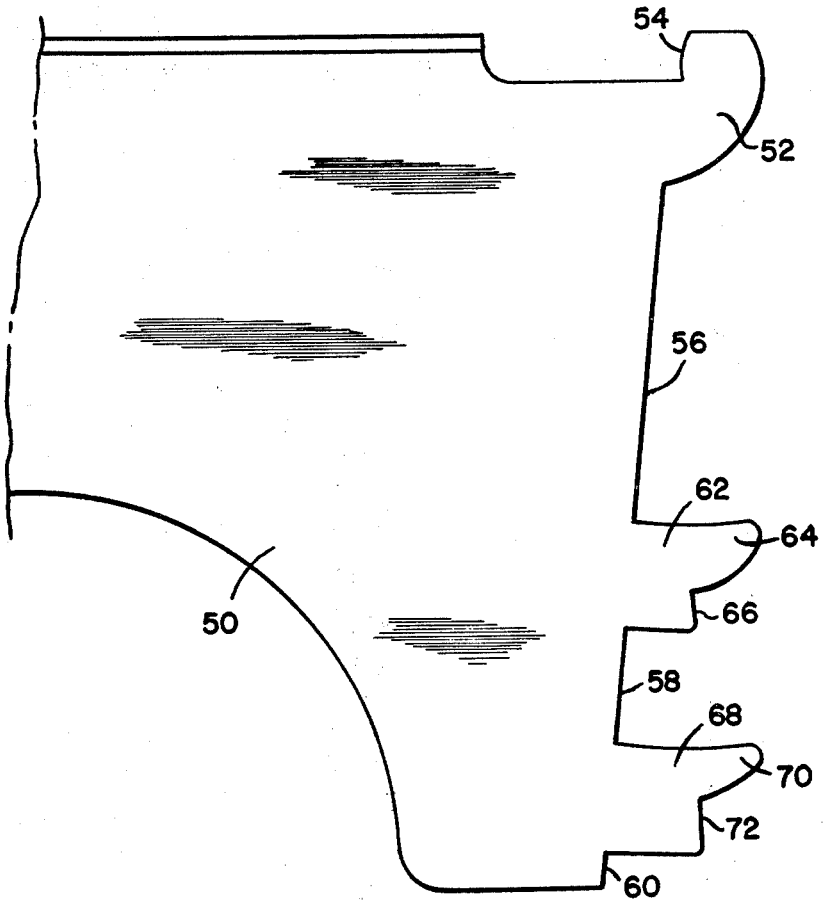
FIG. 2 is a side elevation of the rear portion of a shelf in accordance with the invention, showing the tabs.

Referring to FIG. 2, the shelf, has at either side a vertical, flat, heavy-gauge, sheet metal support 50, having near its upper edge a first tab 52 which extends rearwardly, and then upwardly so that it is adapted to extend through a slot and engage with the rear wall of the support in which the slot is located. The surface 54 which engages the rear wall of the slot is preferably rounded because, as will be seen, this surface engages the rear wall of the support in two different ways, depending on whether the support is vertical or oblique. The rounded configuration at 54 insures minimum stress in both orientations.

Below tab 52 is an edge 56, which is continued in a straight line at 58 and 60. This edge is adapted to abut the front surface of a support.

A second tab 62 comprises a rearwardly extending projection 64 and a heel 66 extending downwardly from projection 64 and rearwardly from edge 58. A third tab 68 also comprises a rearwardly extending projection 70 and a heel 72, which extends downwardly from projection 70 and rearwardly from edge 60.

The manner in which the shelf is secured to vertical support member 34 is illustrated in FIG. 3. Tab 52 extends through one of slots 44, with surface 54 of tab 52 engaging the rear wall 74 of the support. Edge 56 intersects the bottom of tab 52 at 76, and this intersection rests on the bottom of the slot through which tab 52 extends. Projection 64 extends through a lower one of slots 44 with the bottom of the projection resting on the lower edge of the slot. Heel 66 abuts the front surface of the support. Similarly, projection 70 extends through the next lower one of slots 44, and the bottom of projection 70 rests on the lower edge of this slots, with heel 72 abutting the front surface of support 34.

Heels 66 and 72 are aligned with each other and with intersection 76 so that both heels abut the front surface of support 34. The spacing between the bottom of projection 64 and intersection 76 is equal to twice the spacing between the bottoms of adjacent slots. The spacing between the bottom of projection 70 and intersection 76 is equal to three times the spacing between the bottoms of adjacent slots. In this way, vertical support for the shelf is provided at three points. The spacing between intersection 76 and the bottom of a tab could be, of course, any integral multiple of the distance between the bottoms of adjacent slots in support member 34.

Now referring to FIG. 4, which shows the same shelf secured to oblique support 20, it will be seen that slots 32 are spaced farther apart from each other than slots 44. The different spacing of the slots, although considered highly advantageous, is not a part of this invention, and Suttles U.S. Pat. No. 3,983,822 is directed to this feature.

Tabs 62 and 68 extend fully through slots 32 so that aligned edges 56, 58 and 60 abut the front surface of support 20. Again, vertical support is provided at three points, where the tabs rest on the lower edges of the respective slots through which they extend. Because all of the slots in both the vertical and oblique support members must be substantially the same size in order to accommodate tab 52 effectively, tabs 62 and 68 have to be shaped differently from each other in order that both tabs may be vertically supported by the bottoms of their respective slots regardless of which support is being used. This accounts for the fact that, as shown in FIG. 2, projection 64 has a greater vertical dimension than projection 70 and the fact that heel 72 has a greater vertical dimension than heel 66.

A shelf is installed on either support by first tilting it so that tab 52 can enter a slot, and then lowering the shelf to the horizontal position so that tabs 62 and 68 can enter their respective slots. Because of the special spacing and configuration of the tabs, the shelf will automatically assume the horizontal position regardless of which support it is mounted on. While an upper tab corresponding to tab 52 and two lower tabs corresponding to tabs 62 and 68 are preferred because of the support which they provide for the shelf, it will be apparent that a greater or lesser number of tabs may be used if desired.

What has been described thus far applies to the supports on the left-hand side of FIG. 1. The interconnections between the supports and the shelf on the right-hand side of FIG. 1 are similar, and need not be described. Obviously, any number of supports may be used with suitable modifications.

I claim:

1. A system of shelving wherein identical shelves may be mounted interchangeably on supporting members having surfaces disposed at different angles relative to the horizontal, said system comprising:

a first support having a planar front surface disposed at a first angle with respect to the horizontal, and having a series of uniformly spaced slots extending in the vertical direction on said surface, a second support having a planar front surface disposed at a second angle with respect to the horizontal, said second angle being different from said first angle, and having a second series of uniformly spaced slots extending in the vertical direction on said surface, and first and second substantially identical shelves, each having an article-supporting surface and at least two tabs one located above the other and both adapted to extend into slots in said supports, the uppermost of said tabs having means for engaging the rear surfaces of said supports, means defining a first surface adapted to engage the planar front surface of one of the supports, and means, on the other of said tabs, defining a second surface adapted to engage the planar front surface of the other of said supports, and said first shelf being supported on said first support with its said uppermost tab extending into a slot of said first support and with its said first surface engaged with the planar front surface of said first support, said second shelf being supported on said second support with its uppermost tab extending into a slot of said second support and with its said second surface engaged with the planar front surface of said second support, and said first and second surfaces on each shelf being so related to each other and to the front surfaces of said first and second supports that, with said shelves so mounted respectively on said first and second supports, the article-supporting surface of the first shelf is substantially parallel to that of the second shelf.

2. A system of shelving according to claim 1 in which said first and second surfaces are so related to each other and to said first and second supports that, with said shelves so mounted respectively on said first and second supports, both article-supporting surfaces are substantially horizontal.

3. A system of shelving according to claim 1 in which said other of said tabs extends rearwardly from said means defining a first surface.

4. A system of shelving in accordance with claim 1 in which said other of said tabs comprises a projection extending rearwardly from said means defining a first surface, and in which said second surface comprises a heel extending downwardly from said projection at a location between the end of said projection and said first surface.

5. A system of shelving according to claim 1 in which said other of said tabs of said second shelf extends into a slot on said second support.

6. A system of shelving according to claim 1 wherein the planar front surface of one of said supports is substantially vertical, and wherein the planar front surface of the other of said supports is oblique and upwardly facing.

7. A system of shelving according to claim 6 wherein the support having an oblique front surface constitutes part of a base for the system of shelving, and wherein the support having a substantially vertical front surface is removably secured to the upper end of said support having an oblique front surface and extends upwardly therefrom.

8. A system of shelving according to claim 6 wherein the support having an oblique front surface constitutes part of a base for the system of shelving, and wherein the support having a substantially vertical front surface is secured to the upper end of said support having an oblique front surface and extends upwardly therefrom.

9. A system of shelving according to claim 8 in which said first and second surfaces are so related to each other and to said first and second supports that, with said shelves so mounted respectively on said first and second supports, both article-supporting surfaces are substantially horizontal.

* * * * *